US006105201A

United States Patent [19]

Min

[11] Patent Number: 6,105,201

[45] Date of Patent: Aug. 22, 2000

[54] SHOE CLEANING DEVICE

[76] Inventor: Soung Kiy Min, c/o Center Building Corp., 581 Fifth Ave., New York, N.Y. 10017

[21] Appl. No.: 09/321,132

[22] Filed: May 27, 1999

[51] Int. Cl.[7] ..... A47L 5/14

[52] U.S. Cl. ..... 15/302; 15/310; 15/314

[58] Field of Search ..... 15/301, 302, 303, 15/310, 311, 314

[56] References Cited

U.S. PATENT DOCUMENTS

| | | | |
|---|---|---|---|
| 1,658,489 | 2/1928 | Lindstrom | 15/310 |
| 2,953,805 | 9/1960 | Sevenich | 15/310 |
| 3,030,650 | 4/1962 | Kiraly | 15/310 |
| 3,048,867 | 8/1962 | Counts . | |
| 3,064,298 | 11/1962 | Jones . | |
| 3,226,750 | 1/1966 | Leonard . | |
| 3,295,298 | 1/1967 | Mackey | 15/310 |
| 3,526,015 | 9/1970 | Nappi . | |
| 3,529,610 | 9/1970 | Leichner et al. . | |
| 3,737,942 | 6/1973 | Casey . | |
| 3,938,218 | 2/1976 | DeAmicis . | |
| 4,024,599 | 5/1977 | Gamboa | 15/311 |
| 4,026,310 | 5/1977 | Beauregard . | |
| 4,233,707 | 11/1980 | Leblanc . | |
| 4,951,345 | 8/1990 | Nappi . | |
| 5,588,175 | 12/1996 | Zahner . | |
| 5,991,967 | 11/1999 | Williams | 15/311 |

*Primary Examiner*—Terrence R. Till
*Attorney, Agent, or Firm*—Kanesaka & Takeuchi

[57] ABSTRACT

A shoe cleaning device is formed of a housing having an opening to put a shoe to be cleaned, and a low pressure chamber communicating with the opening; an air sucking and compressing device disposed in the housing and communicating with the low pressure chamber for sucking air; a heating chamber disposed in the housing and communicating with an outlet of the air sucking and compressing device; and a nozzle portion disposed outside the housing and having a flow path communicating with the heating chamber to eject compressed air passing through the air sucking and compression device. A liquid valve is attached to the flow path to provide moisture to air passing through the flow path, and a controller connected to the air sucking and compressing device, the heater and the liquid valve for controlling the same. Materials attached to the shoe can be blown out by compressed air ejected from the nozzle and collected through the opening. The shoe can be cleaned by the moisture ejected together with the compressed air and dried by the heater, as well.

5 Claims, 2 Drawing Sheets

SHOE CLEANING DEVICE

BACKGROUND OF THE INVENTION AND RELATED ART STATEMENT

The present invention relates to a shoe cleaning device especially useful for a shoe having spikes on a sole, such as golf shoe, baseball shoe and so on.

In a city, road is mostly covered with asphalt or cement. Therefore, when a people is living in a city, shoes are not generally soiled. Even if the shoes are soiled, as long as the shoes are taken off in a house, the cleaning of the shoes is not so important.

However, shoes with spikes on the sole are often used on a natural field or ground. Since the spikes are attached to the shoes, soil is likely to stick to the shoes. Also, the shoes with the spikes are generally carried to a specific place, and after use, the shoes are taken off and are brought back with or without a cover. Therefore, it is preferable to clean the shoes after use to easily carry the shoes.

Especially, golf shoes are used in a natural field, and soil is likely to attach to the golf shoes. Also, in a golf course, in order to maintain lawn or grasses on a field and green, a large amount of chemical is put on the field and green. Therefore, it is preferable to clean the golf shoes after use.

In order to remove soil from the golf shoe, conventionally, there is a device to eject high pressure air from a nozzle. In this device, soil is blown away by high pressure air ejected from a nozzle handled by a user, but the removed soil scatters all around the area. In this respect, though the subject to be used is different, U.S. Pat. No. 3,938,218 discloses a nozzle to eject pressurized air to remove an attachment. In these mechanisms, soil attached to the shoes can be removed, but chemicals attached to the shoes are not removed.

A golf shoe cleaner was proposed in U.S. Pat. No. 3,226,750, which includes two large wheels with axial bristles, and a shaft connecting the large wheels and having radial bristles projecting outwardly from the shaft. The axial bristles projecting from the large wheels face two sides of a shoe, and the radial bristles contact a sole, by which soil attached to the shoe is removed. In this mechanism, soil attached to the shoe is removed, but chemicals adhered to the shoe is not removed.

As regular shoe cleaners, there are many devices, such as U.S. Pat. Nos. 3,737,942, 4,233,707 and 3,048,867. In these devices, brushes are rotated to contact a shoe to remove soil attached thereto. Soil removed from the shoe may be collected by a vacuum force, and air may be projected to remove an upper part of the shoe. Further, hot air may be ejected from a device to dry the shoe.

In case the brushes are used to remove soil, since soil is likely to stick to the brushes, the brushes must be cleaned frequently. Especially, since a large amount of soil is likely to stick to the shoe with the spikes, if the soil is removed by the brushes, the brushes must be cleaned frequently. Also, the conventional cleaning devices can not easily remove chemicals attached to the shoes.

In view of the above, the present invention has been made, and an object of the invention is to provide a shoe cleaning device which can effectively remove soil attached to a shoe, especially shoe with spikes, without scattering soil around the shoe.

Another object of the invention is to provide a shoe cleaning device as stated above, which can also remove chemicals attached to the shoe.

A further object of the invention is to provide a shoe cleaning device as stated above, which can be formed and operated easily.

Further objects and advantages of the invention will be apparent from the following description of the invention.

SUMMARY OF THE INVENTION

A shoe cleaning device of the invention is especially useful for cleaning a shoe with spikes on the sole, such as golf shoe, baseball shoe, and so on.

The shoe cleaning device includes a housing having an opening to put a shoe to be cleaned, and a low pressure or vacuum chamber communicating with the opening; an air sucking and compressing device disposed in the housing and communicating with the low pressure chamber for sucking air; a heating chamber disposed in the housing and communicating with the sucking and compressing device; a nozzle portion disposed outside the housing and communicating with the heating chamber through a flow path to eject compressed air from a nozzle, and a liquid valve attached to the flow path to provide moisture to compressed air passing through the flow path. A controller is connected to the air sucking and compression device, the heater and the liquid valve for controlling the same.

When the shoe cleaning device is used, a switch is actuated to operate the air sucking and compressing device. As a result, air is sucked through the opening and the low pressure chamber, and compressed air is ejected from the nozzle of the nozzle portion.

In this condition, the shoe is put in the low pressure chamber or on a grid disposed in the opening communication with the low pressure chamber. Then, the nozzle is handled by a user to eject the compressed air on and around the shoe. At this time, since air is sucked through the low pressure chamber, soil and other foreign materials removed from the shoe are generally sucked and collected in the low pressure chamber.

When chemicals sticking to the shoe are removed, another switch is turned on to open the liquid valve to eject moisture together with compressed air, not pressured water, through the nozzle. Thus, chemicals can be removed from the shoe by the moisture. When the shoe is to be dried, the liquid valve is closed, and the heater is turned on to eject hot air through the nozzle.

Preferably, a filter is situated between the low pressure chamber and the air sucking and compressing device, and a tray is disposed under the lower pressure chamber to collect soil and other materials removed from the shoe.

The switches are disposed in the controller, and are fixed to a handle of the nozzle portion. The switches include a first switch having an off position, a liquid valve open position and a heater operating position so that one of the three positions is selected, and a second switch connected to the first switch and the air sucking and compressing device. When the second switch is turned on, the first switch can be operated, and the air sucking and compressing device is turned on.

DETAILED DESCRIPTION OF PREFERRED EMBODIMENTS

The present invention will be explained with reference to the accompanying drawings.

A shoe cleaning device of the invention is especially useful for cleaning a shoe with spikes on a sole thereof, such as golf shoe, baseball shoe, soccer shoe and so on. However, it is possible to clean an athletic shoe and regular shoe without the spikes.

Figure 1:
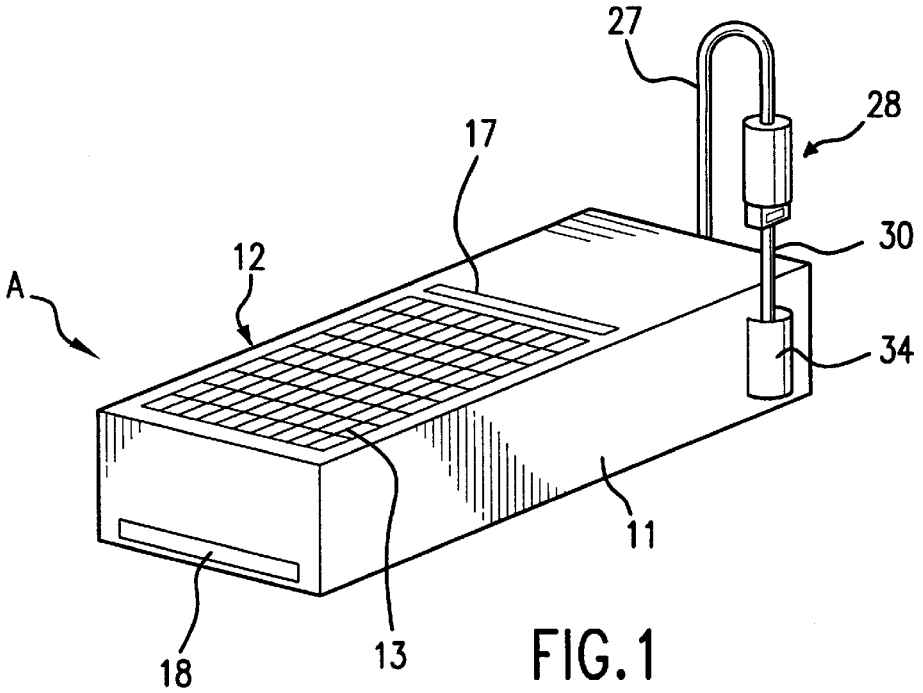
FIG. 1 is an explanatory perspective view of a first embodiment of a shoe cleaning device of the invention.
Figure 2:
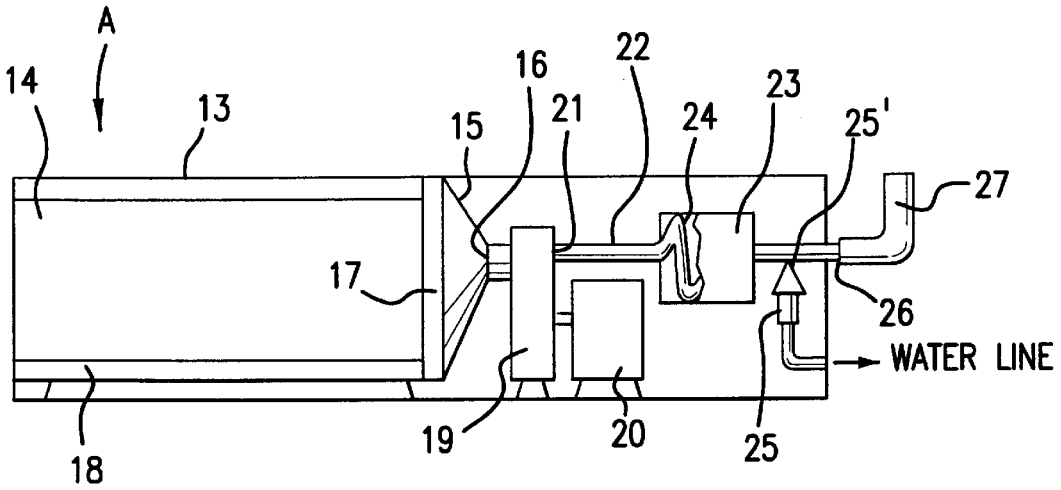
FIG. 2 is an explanatory sectional view of the shoe cleaning device shown in FIG. 1.
Figure 3:
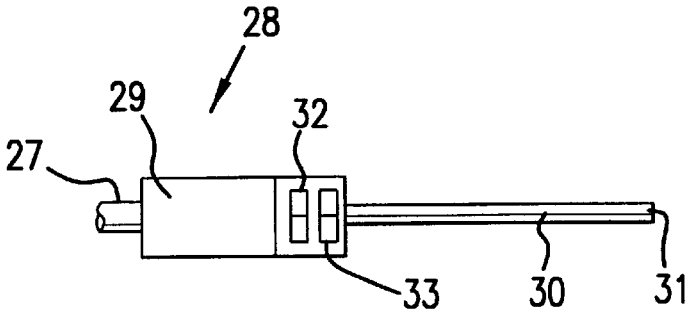
FIG. 3 is a plan view of a nozzle portion of the shoe cleaning device of the invention.

The shoe cleaning device A as shown in FIGS. 1–3 is a single type, and includes a housing 11 having an opening 12 at an upper part thereof, in which a grid 13 is disposed. A vacuum or low pressure chamber 14 closed by a vertical wall 15 is formed inside the housing under the grid 13, in which an air inlet 16 is formed.

Inside the vacuum chamber 14, a filter 17 and a tray 18 are disposed. The filter 17 is located in front of the vertical wall 15 to remove soil and other materials contained in air sucked into the vacuum chamber 14 through the opening 12. The tray 18 holds soil and other materials falling down through the grid 13 and not passing through the filter 17. The filter 17 and the tray 18 are installed into the housing 11 through the walls of the housing 11 for cleaning.

Inside the housing 11, an air blower 19 and a motor 20 are situated. The air blower 19 includes a fan (not shown) to which the motor 20 is attached, an inlet attached to the air inlet 16, and an outlet 21. When the motor 20 is actuated, air is sucked through the opening 12 and the vacuum chamber 14, and is ejected through the outlet 21.

The outlet 21 is connected to a pipe 22 extending to an outside of the housing 11 through a heat chamber 23. Inside the heat chamber 23, there is an electric heater 24, and the pipe 22 extends tortuously to quickly heat air passing through the heat chamber 23. The heater 24 is a panel heater, but any type know in the art may be used. Also, an inlet 25' connected to a water line through an electromagnetic valve 25 is attached to the pipe 22. When the valve 25 is opened, a small amount of water is supplied to the pipe 22 to provide moisture in air.

Attached to an outlet 26 of the pipe 22 is a flexible hose 27 connected to a nozzle portion 28. The nozzle portion 28 includes a handle 29 to be held by a user, and a pipe 30 attached to the handle 29. A nozzle 31 is formed at the front end of the pipe 30 for ejecting compressed air therefrom. Two switches 32, 33 forming a control section are attached to the handle 29.

The switch 32 is connected to the heater 24 and the valve 25, and includes an off position, a valve open position and a heater operating position, so that one of the three positions is taken by the switch 32. On the other hand, the switch 33 is connected to the switch 32 and the motor 20. When the switch 33 is turned on, the switch 32 can be operated, and the motor 20 is operated to suck air through the opening 12 and eject compressed air through the nozzle 31. The switch 33 operates as a safety switch for the switch 32.

Incidentally, a holder 34 is attached to the housing 11 to put the pipe 30 in the holder 34 when the device is not used.

When the shoe cleaning device A is used, the user holds the handle section 28, and the switch 33 is at first turned on. Thus, the motor 20 is actuated to operate the fan in the blower 19. Accordingly, air is sucked through the opening 12, and compressed air is ejected through the nozzle 31. In this condition, the switch 32 is located in the off position.

Then, the user puts one of the shoe, while wearing on a foot, on the grid 13. While moving the foot, the handle 28 is manipulated around the shoe to blow out soil and other materials attached to the shoe. Since air is sucked through the opening 12, soil and other materials removed from the shoe are substantially drawn into the vacuum chamber 14. Soil and other materials are separated by the filter 17, and air is ejected again from the nozzle 31.

When the soil is substantially removed, the switch 32 is changed to the valve position to open the valve 25. Thus, water enters into the pipe 22 to add moisture to the compressed air. The compressed air with moisture is ejected through the nozzle 31, by which the shoe is washed. Then, the switch 32 is changed to the heater position to close the valve 25 and heat the compressed air by the heater 24. The shoe is dried by the heated air ejecting from the nozzle 31. Both shoes are cleaned by the above operation. If desired, soil on the shoe may be blown out by the compressed air with moisture, or heated air.

In the switch mechanism, even if the switch 32 is not turned off, when the switch 33 is turned off, the switch 32 is also turned off. Therefore, the shoe cleaning device can be operated safely. Also, an additional switch may be placed under the grid 13 to be actuated when the shoe is put on the grid 13. If the additional switch is not turned on, i.e. no shoe is put on the grid 13, for a predetermined time, the switch 33 may be turned off.

Figure 4:
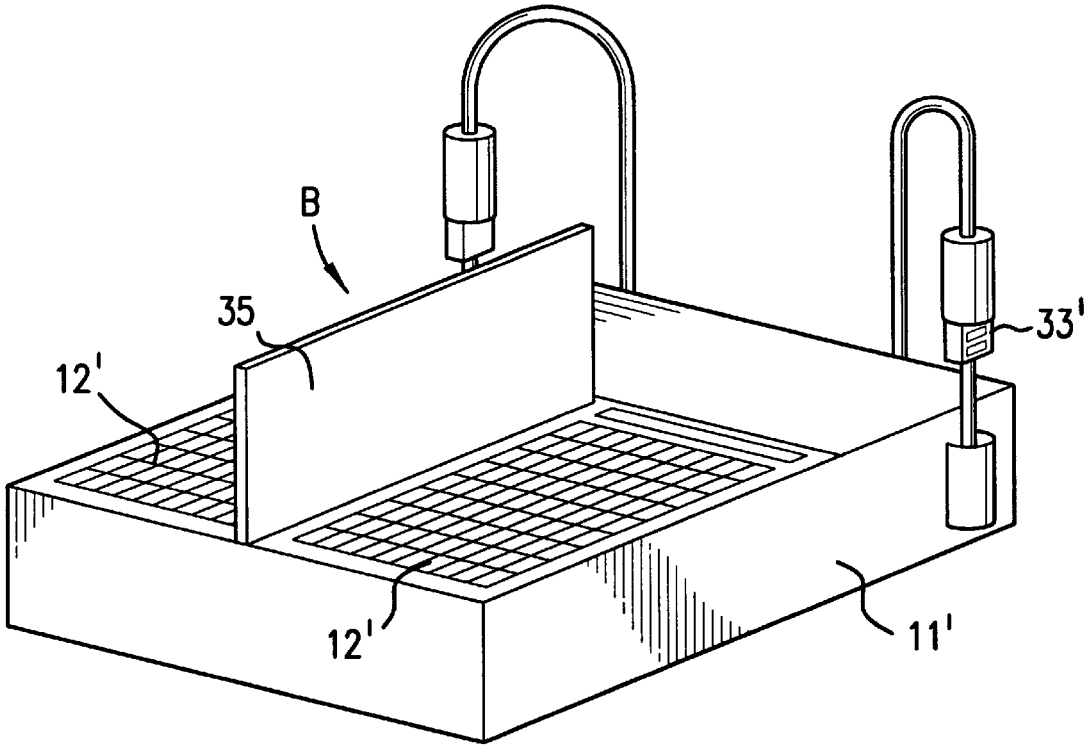
FIG. 4 is an explanatory perspective view of a second embodiment of the shoe cleaning device of the invention.

FIG. 4 shows a second embodiment B of the shoe cleaning device of the invention. The shoe cleaning device B is similar to the shoe cleaning device A as explained above, but the device B includes two systems in one housing 11' with one motor therein. The motor includes two electromagnetic clutches to be connected to each of the blowers. When a switch 33' of one of the systems is actuated, the motor and one of the electromagnetic clutches are turned on to operate the one system. When a switch of the other system is actuated, the other of the electromagnetic clutches is turned on to operate the other system. A plate 35 is formed on the housing 11' to separate the openings 12'. In the embodiment B, the entire system can be made compact.

In the invention, soil and chemicals adhered to a shoe can be cleaned effectively by compressed air ejected from the nozzle, and are sucked into the vacuum chamber. The shoe can be cleaned easily and safely.

While the invention has been explained with reference to the specific embodiments of the invention, the explanation is illustrative and the invention is limited only by the appended claims.

What is claimed is:

1. A shoe cleaning device, comprising:

a housing having an opening adapted to put a shoe to be cleaned, and a low pressure chamber communicating with the opening, an air sucking and compressing device disposed in the housing and having an inlet communicating with the low pressure chamber for sucking air, and an outlet, a heating chamber disposed in the housing and communicating with the outlet, said heating chamber having a heater therein, a nozzle portion disposed outside the housing and having an exit, and a flow path communicating with the exit and the heating chamber to eject compressed air passing through the air sucking and compression device from the exit, a liquid valve attached to the flow path to provide moisture to air passing through the flow path, and a controller connected to the air sucking and compressing device, the heater and the liquid valve for controlling the same so that materials attached to the shoe can be blown out by compressed air ejected from the nozzle and collected through the opening.

2. A shoe cleaning device according to claim 1, further comprising a grid to cover the opening of the housing to allow the shoe to be cleaned on the grid, a filter situated between the low pressure chamber and the air sucking and compressing device, and a tray disposed under the lower pressure chamber to collect the materials removed from the shoe.

3. A shoe cleaning device according to claim 2, wherein said liquid valve is disposed in the housing outside the heating chamber.

4. A shoe cleaning device according to claim 3, wherein said heating chamber includes a tortuous line connected to the flow path, said heater heating the heating chamber entirely.

5. A shoe cleaning device according to claim 4, wherein said controller includes a first switch having an off position, a valve open position and a heater operating position so that one of the three positions is selected, and a second switch connected to the first switch and the air sucking and compressing device so that when the second switch is turned on, the first switch and the air sucking and compressing device are actuated.

* * * * *